United States Patent [19]

Ogles

[11] 3,975,113

[45]*Aug. 17, 1976

[54] CENTRIFUGAL PUMP

[76] Inventor: Ethridge F. Ogles, Rte. No. 4, Ada, Okla. 74820

[ * ] Notice: The portion of the term of this patent subsequent to June 11, 1991, has been disclaimed.

[22] Filed: Dec. 31, 1974

[21] Appl. No.: 537,658

[52] U.S. Cl. ..... 415/180; 415/112; 415/175; 415/213 R; 415/199 A

[51] Int. Cl.[2] ..... F04D 29/58

[58] Field of Search ..... 415/170 A, 170 B, 172, 415/173, 175, 180, 178, 174, 112, 111, 199 A

[56] References Cited

UNITED STATES PATENTS

| | | | |
|---|---|---|---|
| 2,393,808 | 1/1946 | Ponomareff | 415/175 |
| 2,427,656 | 9/1947 | Blom | 415/170 B |
| 2,687,096 | 8/1954 | Armacost | 415/180 |
| 3,816,020 | 6/1974 | Ogles | 415/111 |

FOREIGN PATENTS OR APPLICATIONS

| | | | |
|---|---|---|---|
| 809,758 | 8/1951 | Germany | 415/170 A |
| 536,916 | 5/1941 | United Kingdom | 415/170 A |

OTHER PUBLICATIONS

Norton, R. D., *Mechanical Seals.*, in Chemical Engineering, pp. 199–210, Sept. 1956.

*Primary Examiner*—Henry F. Raduazo
*Attorney, Agent, or Firm*—Clarence A. O'Brien; Harvey B. Jacobson

[57] ABSTRACT

A rotary centrifugal pump having an axial inlet and discharge in a casing together with an impeller having liquid impelling vanes on both surfaces thereof with the impeller having central openings enabling inlet liquid to be impelled by vanes on both surfaces of the impeller with the impeller being provided with spaced annular seal rings mounted on each side thereof. The pump includes a water cooled lubricant for a bearing and a seal box in which lubricant is maintained under pressure by the liquid being pumped. The pump is adapted for use as a single stage, multiple stage, or deep hole pump and is capable of producing relatively high pressures and high volume discharge.

14 Claims, 8 Drawing Figures

10
12
14
16
18
20
22
24
26
27
3
40
42
44
48
50
52
54
74
76
77
84
94
154
156
157
176
177
178

CENTRIFUGAL PUMP

BACKGROUND OF THE INVENTION

1. Field of the Invention

The present invention generally relates to a rotary pump having axial intake and discharge and an impeller having vanes on both sides thereof for producing a high discharge pressure and including novel and unique features rendering the pump more efficient.

2. Description of the Prior Art

Rotary pumps generally of this type have been provided for pumping liquids under various circumstances. An example of one type pump for this purpose is found in my prior U.S. Pat. No. 3,816,020, issued June 11, 1974, the disclosure of which is incorporated herein by reference thereto.

SUMMARY OF THE INVENTION

An object of the present invention is to provide a rotary pump incorporating a casing having a rotary impeller disposed therein with the impeller having vanes on both surfaces thereof and central openings with both surfaces of the impeller having floating seal rings mounted on the vanes.

Another object of the invention is to provide a pump in which the casing is provided with a deflector with edge rings and passageways for guiding, directing and discharging the fluid being pumped from the outer peripheral portion of the impeller in a radially inward direction for discharge axially of the pump or axially into a subsequent stage of the pump.

Another object of the invention is to provide a pump in accordance with the preceding objects in which the power shaft which drives the impeller is supported from the casing or other stationary support by an oil lubricated bearing assembly in which the oil is cooled by the fluid being pumped and the power shaft is also sealed by a unique spring-biased, lubricated seal arrangement.

A further important object of the present invention is to provide a rotary pump in which the impeller has central annular ring members thereon generally in sealing relation to the housing with the impeller being accurately positioned and supported in relation to the casing by the bearing and supporting structure for the drive shaft and a tail shaft provided on the impeller that is journalled in the casing with a pressure equalizing tube communicating the shaft bearing and outer portion of the casing.

Yet another significant object of the invention is to provide a rotary pump of the centrifugal type capable of discharge of liquid at a relatively high volume and high pressure which is efficient in operation, capable of assembly into a single stage or any number of stages depending upon the output pressure desired, long lasting and dependable in operation and relatively inexpensive to manufacture and maintain.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 1, 2, 5:
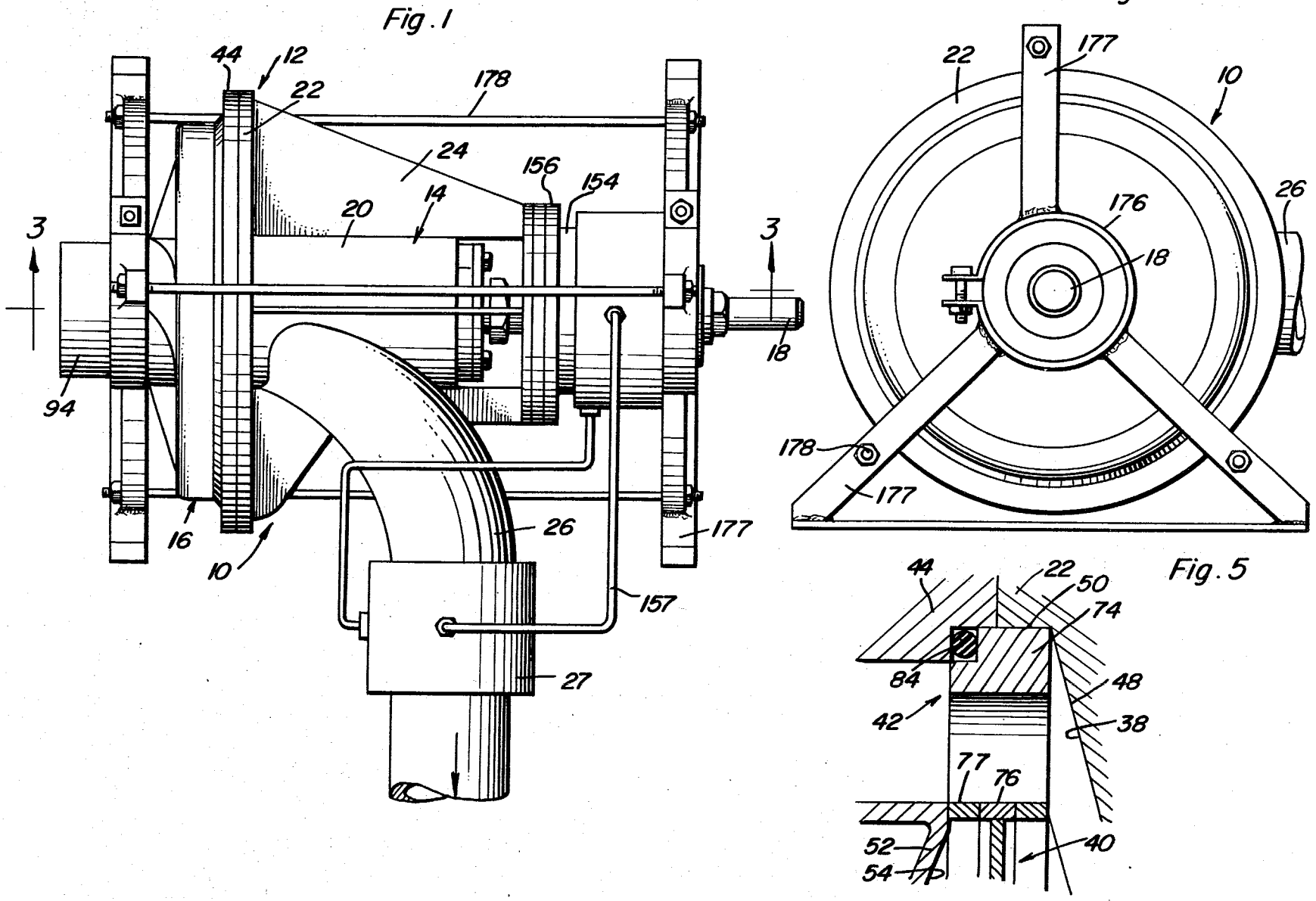
FIG. 1 is a plan view of the pump.
FIG. 2 is an end view of the pump.
FIG. 5 is an enlarged fragmental sectional view of the deflector.

Referring now specifically to the drawings, the pump of the present invention is generally designated by reference numeral 10 and includes a casing generally designated by the numeral 12 which includes an intake portion 14 and a discharge portion 16. The pump is supplied with rotational power by virtue of a power shaft 18 oriented longitudinally in the casing 12 with the input end thereof projecting from the intake portion of the casing for connection with a suitable power source such as an internal combustion engine, electric motor or the like by any suitable means so that the shaft 18 may be rotated at a desired rotational speed with a desired torque.

The intake portion 14 of the casing 12 includes a longitudinally extending hollow cylindrical member 20 having a circular plate 22 rigid with one end thereof with reinforcing gussets 24 bracing and rigidifying the tubular member 20 and plate 22 with respect to each other. The tubular member 20 is provided with a laterally extending, smoothly curved adapter tube 26 which forms an inlet for the pump and is connected to a suitable pipe, conduit or the like for supplying liquid such as water to the pump.

The gussets 24 extend beyond the end of the tubular member 20 and rigidly support an annular flange 30 on which is mounted a bearing assembly 34 which journals and supports the shaft 18. The end of the tubular member 20 is spaced from the flange 30 and receives a seal assembly 36 which sealingly engages the shaft 18 and prevents water leakage along the shaft 18 from the interior of the pump.

The casing 12 includes a hollow chamber 38 which may be considered the working chamber of the pump and is annular in configuration and this chamber receives an impeller generally designated by the numeral 40 and an annular deflector ring 42 which is stationary with respect to the casing with the impeller rotating with the shaft 18.

Figure 3:
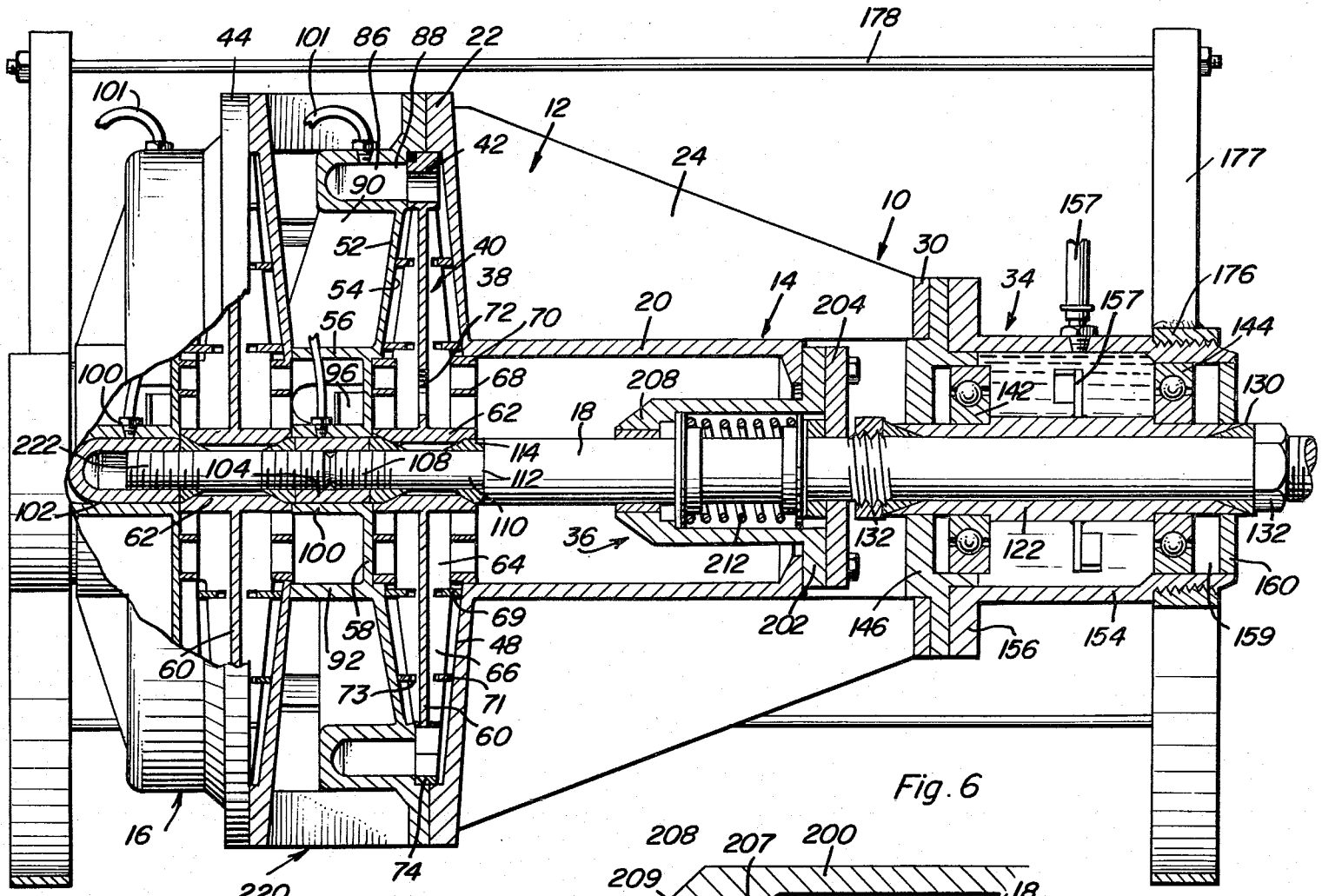
FIG. 3 is a longitudinal, sectional view taken substantially upon a plane passing along section line 3—3 of FIG. 1 illustrating the relationship of the structural components of the pump when in a multi-stage arrangement.
Figure 6:
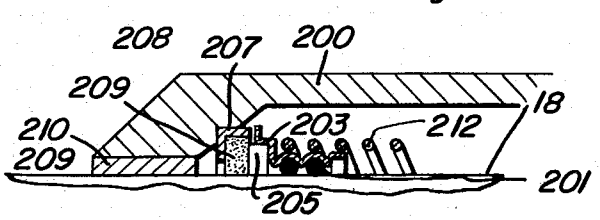
FIG. 6 is an enlarged fragmental sectional view of the seal box.

As illustrated in FIG. 3, the plate 22 abuts and is rigid with a flange 44 on the discharge portion 16 of the casing with the periphery of the plate 22 also defining a flange that is secured in rigid relation with the flange 44 by suitable through bolts. The interior surface of the plate 22 is inclined as at 48 with the inner edge of the inclined surface 48 merging with the interior of the tubular member 20 and the outer edge of the inclined surface 48 being defined by a shoulder 50 that extends peripherally of the plate 22 inwardly of the circumference thereof.

The discharge portion of the casing 16 also includes a plate 52 which has an inclined surface 54 that is integral with the flange 44 and diverges from the inclined surface 48 and cooperates therewith to define the hollow chamber 38 which receives the impeller 40. Centrally of the plate 52, there is provided an annular shoulder or recess 56 that is the same diameter as and in alignment with the interior of the tubular member 20 with the rear limit of the recess or shoulder 56 being defined by a circular plate 58 which forms a rearward partition wall or closure for the hollow chamber 38.

Figure 4:
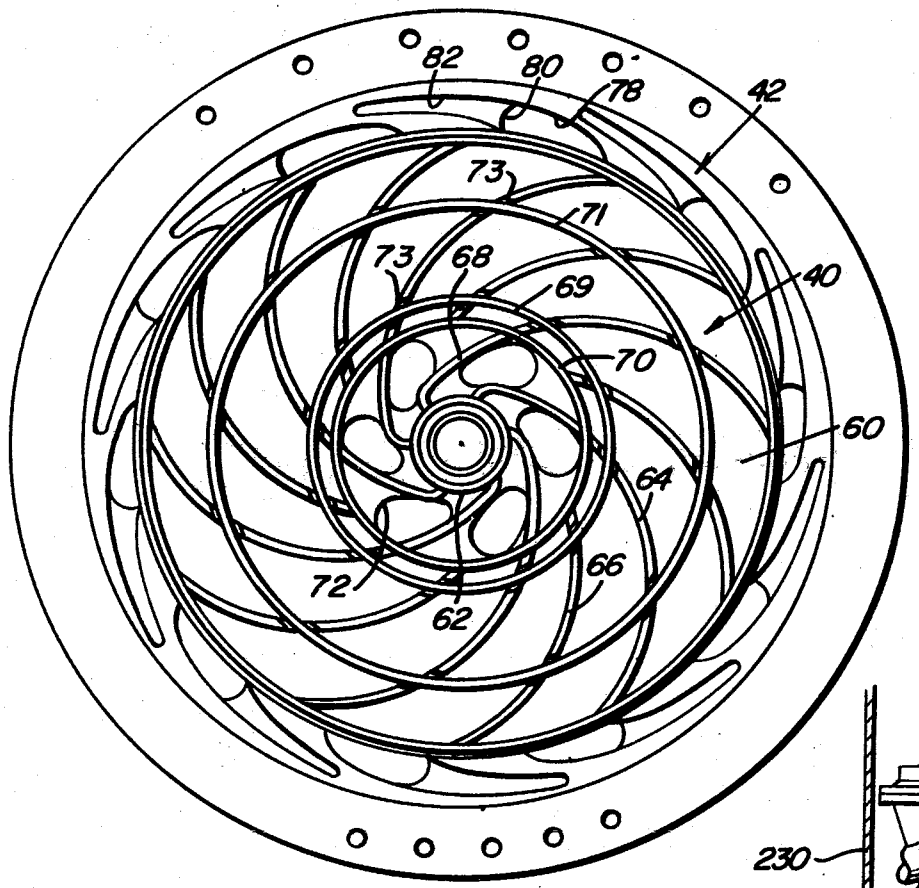
FIG. 4 is an end elevational view of the impeller and associated deflector ring and casing with the discharge portion of the casing removed.

As illustrated in FIGS. 3 and 4, the impeller 40 includes a circular plate 60 having a centrally disposed tubular hub 62 therein which extends to both sides of the plate 60. Each side of the plate 60 is provided with a plurality of radially extending but arcuately curved vanes 64 and 66 with the vanes 64 and 66 being in alternate relationship. The vanes 64 extend completely inwardly to and are joined with the hub 62 while the inner ends of the vanes 66 terminate in circumferentially spaced relation to the hub 62. The inner ends of the vanes 64 have the same depth as the length of the hub 62 projecting from the plate 60 with the inner end portions of the vanes 64 being designated 68 defining axially extending shoulders on which is mounted an annular ring 70 that is rigidly secured to the vanes 64 with the outer edge of the ring 70 generally being flush with the end of the hub 62 as illustrated in FIG. 3. The vanes 66 terminate in alignment with the ring 70 with the vanes 64 and 66 being rigidly secured to the plate 60 and substantially equally spaced with the omission of the inner ends of the vanes 66 providing an open area inwardly of the ring with an elongated and generally oval-shaped opening 72 being provided in the plate 60 with the openings 72 communicating between the two sides of the plate 60. The relationship of the openings 72, the vanes 64 and 66 and the annular ring 70 is illustrated in FIG. 4 with the relationship of the rings 70 to the interior of the tubular member 20 and the shoulder or recess 56 being illustrated in FIG. 3. Thus, as water enters through the inlet 26 into the tubular member 20 it will flow through the ring 70 received in the tubular member 20 with the water being divided with a portion of it being impelled outwardly along the surface of the impeller plate 60 facing the tubular member 20 and the remaining portion of the water passing through the openings 72 and moving radially outwardly and being impelled by the vanes on the opposite side of the impeller plate 60 thereby providing effective movement of the water or other liquid during rotation of the impeller 40 in a counterclockwise direction as viewed in FIG. 4 with the vanes being arcuately carved so that such rotation will impel the water or other liquid outwardly in the annular chamber 38 toward the periphery of the casing 12 where it comes into contact with the deflector ring 42. A pair of concentrically spaced rings 69 and 71 are loosely received in groove 73 formed in the vanes 64 and 66 to form multiple seals between the impeller and casing.

The deflector ring 42 includes an annular member 74 which has an inner edge 76 that closely surrounds the impeller plate 60 and has a width substantially equal to the width of the combined impeller plate 60 and the outer ends of the vanes 64 and 66. The inner edge 76 of the annular member 74 is provided with a plurality of arcuately extending notches 78 defined by an outer periphery that tapers from the inner edge 76 towards the outer edge of the annular member in the direction of rotation of the impeller plate 60 with the terminal edge of each notch 78 being substantially radially disposed on the side of the annular member 74 which faces the plate 22 as designated by numeral 80 in FIG. 4. The opposite side of each notch 78, that is, where the notch communicates with the surface of the annular member 74 which faces the discharge portion 16 of the casing, the annular member is provided with an elongated arcuately curved and tapering groove 82 which extends in the direction of rotation of the impeller so that the water which is discharged from the impeller will enter the notches 78 and be deflected or directed toward the discharge portion 16 of the casing by the tapering configuration of the groove 82 which commences at the radial edge 80 which is substantially a feather edge or very thin edge and inclined towards the surface of the annular member 74 which faces the discharge portion 16 of the casing. In order to seal the annular member 74 in relation to the casing, an O-ring of neoprene, or the like designated by numeral 84 is provided between the inner edge of the flange 44 which has a recess therein and a corresponding peripheral notch or recess in the annular member 74. As illustrated, the plate 52 of the discharge portion is closely adjacent to the annular member 74 and serves to define the outer portion of the hollow chamber 38. The inner edge 76 of annular member 74 also includes two continuous narrow rings 77 to guide and control water flow into the notches 78.

At the inner edge of the flange 44, a plurality of tapering channels or passageways 86 are provided which commence as shallow grooves at the inlet end 88 thereof and progressively deepen in the direction of rotation of the impeller and movement of the water or liquid until they reach a maximum axial depth and communicate with a radially, inwardly extending curved passageway 90 which extends to and communicates with the interior of a tubular member 92 which forms an extension on the plate 58 and which includes an internally threaded extension 94 in FIG. 1 that defines a discharge pipe for the liquid being pumped. There are three circumferentially spaced and isolated channels or passageways 86 provided with the tapering of the groove 86 being gradual and continuous into the passageway 90 with the juncture between the passageway 86 and the passageway 90 being smoothly curved and rounded with the bottom limits of the passageway 86 also being curved and generally of U-shaped configuration. Where the water or liquid exits from the passageway 90 into the hollow interior of the tubular member 92, curved deflectors 96 are provided for deflecting the water and making more efficient movement of the water possible.

The circular plate 58 is provided with a tubular member 100 extending axially in inward concentric relation to the tubular member 92 with the outer end thereof being rounded and closed as at 102 when only a single stage pump is being used. The tubular member 100 forms a bearing member for an internally threaded member 104 on the shaft 18. The member 104 has an external surface that is journalled in the interior surface of the tubular member 100 and includes radial openings for receiving a spanner wrench or the like for threading the member 104 rigidly onto the threaded end 108 of a reduced end portion 110 on the shaft 18. The reduced end portion 110 is received within the hub 62 of the impeller 40 and includes a shoulder 112 at the inner end of the reduced end portion 110. The reduced end portion 110 receives a pair of tapered split collars 114 thereon with the inner collar having its large end abutted against the shoulder 112 and the outer collar received in the discharge end of the impeller hub 62 with the end portions of the hub 62 being bevelled at an angle corresponding to the external surfaces of the collars 114. Also, the hub 62 and the reduced end portion 110 is grooved to receive a key in order to securely lock the impeller 40 to the shaft 18 but enable disassembly thereof. As the member 104 is rotated, the internal threads thereon will fixedly assemble the impeller 40 on the shaft 18 with the shaft and impeller being concentrically oriented due to the tapered split collars 114. The threaded connection of the member 104 also enables the pump to be assembled into a multiple stage pump in a manner defined hereinafter and if desired, the tubular member 100 is provided with a tube 101 communicated with the discharge passage 86 to equalize pressure and supply water to the exterior of member 104.

Referring now specifically to FIG. 3, the bearing assembly 34 includes a tubular sleeve 122 received on the power shaft between threaded portions thereon. The ends of the sleeve 122 are internally tapered and tapered split collars 130 are mounted on the shaft 18 in engagement with the tapered ends on the sleeve 122 and nuts 132 are threaded onto the threaded portions to rigidly fix the sleeve 122 on the shaft 18 in concentric relation thereto. The external surface of the sleeve 122 is provided with reduced end portions which define shoulders which receive conventional bearing assemblies 142 and 144 respectively.

The bearing assembly 34 also includes an inner end plate 146 that is apertured for alignment with and engagement with the flange 30 and the apertures therein. One side of the plate 146 is provided with a projecting shoulder which extends into the interior of the flange 30 and the opposite side of the plate 146 is provided with a cylindrical extension which defines a seat for engaging the external race of the bearing assembly 142. The bearing assembly 34 also includes a tubular member 154 which includes an outwardly extending flange 156 on its inner end having apertures therein for engagement with the plate 146 and registry with the openings therein so that bolts may be employed for securing the bearing assembly to the flange 30. The flange 156 and the internal dimension of the tubular member 154 engage the extension on the plate 146 to provide for accurate alignment thereof and the outer end of the tubular member 154 is provided with an inwardly extending flange 160 which engages the outer race of the bearing assembly 144 and the bolts which extend through the flanges 156 and 30 and the plate 146 serve to retain the bearing assembly 34 in position and accurately support and align the shaft 18 with respect to the casing 12 which provides for accurate positioning of the rotary impeller in relation to the casing 12. Seals 159 are provided outwardly of each bearing and the space between 154 and 122 is filled with oil which is circulated through a cooling jacket 27 on intake 26 through tubes 157 by an impeller 155 mounted on sleeve 122.

Supporting brackets 176 are provided each of which may include a split clamp sleeve or a casting which encircles a reduced end portion on the tubular member 154 and a corresponding surface on the discharge pipe or tubular member 92 respectively. Each bracket includes three radial arms 177 which are used to support the pump and to receive through bolts 178 to rigidify the pump when multiple stages are used.

The seal assembly 36 includes a tubular member 200 receiving seal elements with a retaining flange 202 and plate 204 serving to retain the seal assembly in place. The inner end of the tubular member 200 is bevelled or tapered at 208 and a bushing 210 engages the shaft 18. The seal includes a ceramic ring 209 having a rubber grommet 207 seating it in a recess, a carbon ring 205 and a brass ring 203 engaged therewith and an O-ring 201 in the ring 203. A spring 212 extends between similar seals at each end of tubular member 200 which protects against high pressure water coming through the seal box. The seal is lubricated in the same manner as in my aforementioned patent.

With this construction, as the shaft is rotated, water enters through the inlet through the intake tubular member 20 and is pumped by the impeller and discharged through the notches and grooves in the deflector ring, the passageways in the discharge portion of the housing and out through tubular member 92 into the discharge pipe 94. All components are maintained at a desired thickness which will provide the requisite strength and at the same time all flow restrictions are reduced by eliminating sharp corners and providing deflecting vanes, guides and the like for water passing through the pump.

The pump may be converted from a single stage pump as illustrated in FIG. 1 to a multiple stage pump as illustrated in FIG. 3 by the insertion of an adapter 220 between the intake portion 14 of the casing and the discharge portion 16 thereof. The adapter 220 includes a duplicate of the plate 52, inclined surface 54 and the other associated structure of the discharge portion except that the tubular member 100 is provided at its rearmost end with a duplicate of the plate 22 and the inclined surface 48 thereon which, when combined with the discharge portion 16 defines a second chamber the same as the hollow chamber 38 so that a second rotor positioned thereon will pump the water through the second stage of the pump. In inserting the adapter, it is only necessary to remove the discharge portion 16 from the intake portion 14 and a shaft extension 222 is attached to the shaft 18 by threaded member 104. The extension 222 is the same diameter as and abuts the end of end portion 110 and, in effect, forms an extension of the reduced end portion 110 of the shaft 18. The discharge portion 16 is then reassembled onto the adapter 220.

Figure 7:
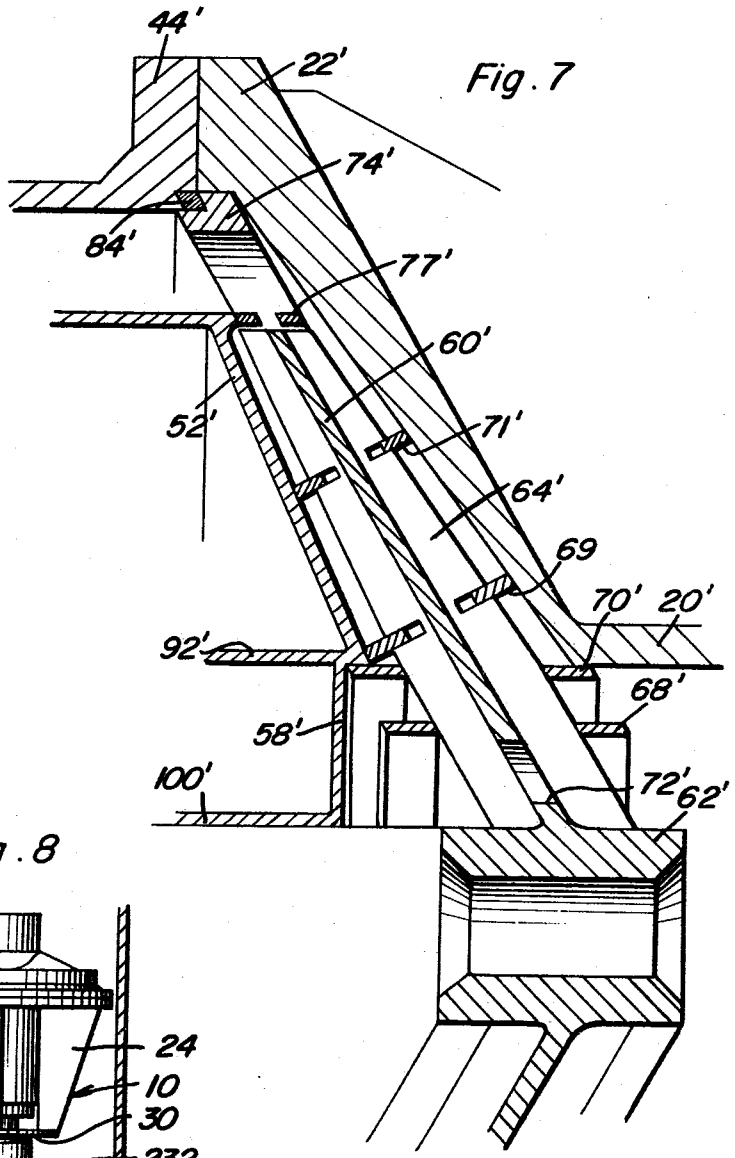
FIG. 7 is a sectional view of a modified form of impeller and pump casing.

FIG. 7 illustrates a slightly modified form of the pump construction in which the same reference numerals are applied except they are primed. In this construction, both the impeller plate 60′ and the corresponding portions of the casing 22′ and 52′ are angulated and define generally a conical construction with the angle of inclination being any desired angle, usually not exceeding 30°. With this construction, the axial inlet flow has a less change of direction to facilitate movement outwardly along both surfaces of the impeller plate 60′.

Figure 8:
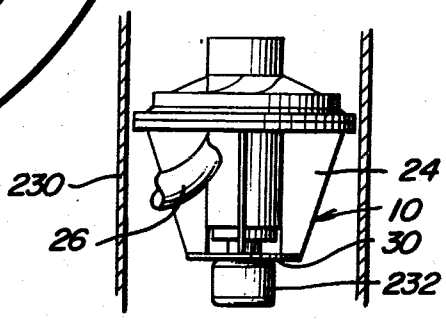
FIG. 8 is a schematic illustration of a deep hole pump arrangement using the structure of the present invention.

FIG. 8 illustrates on a reduced scale and schematically, the manner in which the pump may be employed as a deep hole pump or submersible pump in which it is inserted in a casing 230 and driven by a motor 232. In converting the pump for this construction, the bearing box and related assembly is removed and the motor 232 connected to the shaft 18 in a conventional manner and also connected to the flange 30. Also, in this construction, the periphery of the casing may be omitted exteriorly of the deflector 42 thus decreasing the overall diameter of the pump. With the periphery of the casing engaging the interior of the well casing 230, the multiple stages of the pump will be stabilized thus eliminating the necessity of using the through bolts inasmuch as the shaft 18 forms a connection between the various stages. With this arrangement, any number of stages may be superimposed one upon the other thereby providing a multiple stage deep hole pump capable of high pressure, high volume and high vertical lift.

In operation, the floating rings 69 and 71 will engage the interior surfaces of the chamber such that recirculation of water radially inwardly of the inclined surface 48 or 54 will not occur thereby increasing the pressure output and efficiency of the pump. The structure of the bearing and the water cooled lubricant therein as well as the structure of the seal box more effectively seal the pump and journal the pump shaft. A filter may be incorporated into the pressure equalizing tube to preclude the entry of any foreign material between the exterior of the threaded member 104 and the tubular member 100.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be restored to, falling within the scope of the invention.

What is claimed as new is as follows:

1. A rotary pump comprising a casing having an interior hollow chamber, a rotary impeller disposed in said chamber, a shaft connected with said impeller and extending exteriorly of the casing for rotatably driving the impeller, inlet means in said casing for admitting flowable material to be pumped to the central portion of the impeller, said impeller including vanes thereon for impelling the material as the impeller rotates, outlet means incorporated into the casing and communicating with the portion of the casing receiving the periphery of the impeller for receiving the material impelled by the impeller, said outlet means including inwardly extending passage defining means communicating with an outlet pipe generally coincident to the rotational axis of the impeller, said impeller being in the form of a substantially circular plate, said vanes being disposed radially on each surface of the plate, the central portion of the plate including aperture forming means therein enabling flowable material to be impelled by the vanes on both sides of the impeller, said inlet means being in the form of a tubular member having an inlet pipe communicated therewith, said shaft being disposed in said tubular member, seal means interconnecting the shaft and tubular member outwardly of the inlet pipe for sealing the shaft, and bearing means on said casing axially outwardly of the tubular member for supporting said shaft in relation to the casing, lubrication means for said bearing means, and means circulating lubricant in relation to the bearing means and a cooling jacket associated with the inlet for preventing excessive temperatures occurring in the bearing means.

2. The structure as defined in claim 1 wherein said means enabling circulation of lubricant including a pipe extending from the periphery of a chamber enclosing the bearing means to the cooling jacket, a pipe communicating with the cooling jacket to return the lubricant to the chamber, and an impeller on the shaft in the chamber for circulation of the lubricant.

3. The structure as defined in claim 1 wherein said impeller includes a centrally disposed annular ring on each side thereof in encircling relation to the aperture means, said rings being received closely within said casing.

4. The structure as defined in claim 1 wherein said outlet means includes a substantially circular plate defining the rear surface of the chamber, said radially extending passage defining means being rigid with said plate, tapering inlet channels communicating the outer periphery of the chamber with the radial passage defining means.

5. The structure as defined in claim 4 wherein said casing is provided with a deflector ring at the outer periphery of the impeller, said deflector ring including a plurality of radial notches in the inner edge thereof with each of the notches including an inclined surface extending circumferentially in the direction of rotation and inclined axially toward the channels for deflecting the material being pumped into the channels and passage defining means for discharge, and a pair of axially spaced annular rings along the inner edge of the deflector in spanning relation to the notches.

6. The structure as defined in claim 5 together with an insert adapter for converting the pump to a multiple stage pump, said casing including an inlet portion and a discharge portion, said portions of the casing being separable at the outer periphery of the chamber, said insert adapter including a duplication of the discharge portion and the inlet portion of the casing, a duplication of the impeller and deflector ring and an extension for the drive shaft for enabling a single or multiple number of insert adapters to be incorporated into the pump to enable any number of stages to be provided.

7. The sturcture as defined in claim 1 wherein said rotary impeller includes a hub received on said shaft, means rigidly fixing the hub to said shaft, each end of the hub having a tapering internal surface, a pair of split tapered collets interposed between the shaft and the tapered ends of the hub with at least one of the collets being longitudinally movable on the shaft for centering the hub and impeller in relation to the shaft, and screw-threaded means connected with the shaft for moving the collets toward each other for securing the hub fixedly in concentric relation to the shaft.

8. The structure as defined in claim 1 wherein said aperture means in the impeller includes a plurality of openings through the plate to provide hydraulic balance to both surfaces of the impeller plate.

9. The structure as defined in claim 1 wherein said seal means includes a tubular member disposed concentrically within the tubular member defining the inlet means and receiving a pair of spaced seal assemblies therein in sealing engagement with the shaft, lubrication means for said seal rings, and spring means biasing said seal assemblies away from each other, each seal assembly including a ceramic ring and carbon ring and a retainer ring encircling the shaft and engaging the tubular member, and a spring biasing the retainer rings apart.

10. A rotary pump comprising a casing having an interior hollow chamber, a rotary impeller disposed in said chamber, a shaft connected with said impeller and extending exteriorly of the casing for rotatably driving the impeller, inlet means in said casing for admitting flowable material to be pumped to the central portion of the impeller, said impeller including vanes thereon for impelling the material as the impeller rotates, outlet means incorporated into the casing and communicating with the portion of the casing receiving the periphery of the impeller for receiving the material impelled by the impeller, said outlet means including inwardly extending passage defining means communicating with an outlet pipe generally coincident to the rotational axis of the impeller, said impeller being in the form of a substantially circular plate, said vanes being disposed radially on each surface of the plate, the central portion of the plate including aperture means therein enabling flowable material to be impelled by the vanes on both sides of the impeller, said inlet means being in the form of a tubular member having an inlet pipe communicated therewith, said shaft being disposed in said tubular member, seal means interconnecting the shaft and tubular member outwardly of the inlet pipe for the shaft, and bearing means on said casing axially of the tubular member for supporting said shaft in relation to the casing, and circumferential seal rings mounted loosely on the vanes on each side of the impeller for engagement with the chamber for reducing outward flow of material along the surface of the chamber past the outer edges of the vanes.

11. The combination of claim 10 wherein said casing is provided with a deflector ring at the outer periphery of the impeller, said deflector ring including a plurality of radial notches in the inner edge thereof with each of the notches including an inclined surface extending circumferentially in the direction of rotation and inclined axially toward the channels for deflecting the material being pumped into the channels and passage defining means for discharge, and a pair of axially spaced annular rings along the inner edge of the deflector in spanning relation to the notches.

12. The combination of claim 10 together with an insert adapter for converting the pump to a multiple stage pump, said casing including an inlet portion and a discharge portion, said portions of the casing being separable at the outer periphery of the chamber, said insert adapter including a duplication of the discharge portion and the inlet portion of the casing, a duplication of the impeller and deflector ring and an extension for the drive shaft for enabling a single or multiple number of insert adapters to be incorporated into the pump to enable any number of stages to be provided.

13. The combination of claim 10 wherein said seal means includes a sleeve disposed concentrically within the tubular member, a pair of spaced seal assemblies disposed in said sleeve, and spring means biasing said seal assemblies away from each other, each seal assembly including a ceramic seal ring adjacent remote ends of the sleeve, a carbon ring inwardly of each ceramic ring and an O-ring seal means inwardly of each carbon ring with said spring means engaging said O-ring seal means.

14. The combination of claim 10 together with lubrication means for said bearing means, and means circulating lubricant in relation to the bearing means and a cooling jacket associated with the inlet for preventing excessive temperatures occurring in the bearing means.

* * * * *